US005790030A

United States Patent [19]

Lievens et al.

[11] Patent Number: 5,790,030

[45] Date of Patent: Aug. 4, 1998

[54] MAGNETIC ANTIPILFERAGE TAG

[75] Inventors: Hugo Lievens, Ghent; Paul Lippens, Kortemark; Pascal Verheyen, Gavere, all of Belgium

[73] Assignee: Innovative Sputtering Technology, Zulte, Belgium

[21] Appl. No.: 646,950

[22] Filed: May 8, 1996

[30] Foreign Application Priority Data

May 24, 1995 [EP] European Pat. Off. ..... 95201368

[51] Int. Cl.[6] ..... G08B 13/14

[52] U.S. Cl. ..... 340/572; 365/173; 428/611

[58] Field of Search ..... 340/572, 551; 365/173; 428/611; 148/100, 120

[56] References Cited

U.S. PATENT DOCUMENTS

| | | | |
|---|---|---|---|
| 3,623,038 | 11/1971 | Franklin | 365/173 |
| 4,960,651 | 10/1990 | Pettigrew et al. | 340/572 X |
| 5,083,112 | 1/1992 | Piotrowski et al. | 340/572 |
| 5,121,106 | 6/1992 | Kataria et al. | 340/572 |
| 5,126,715 | 6/1992 | Yerman et al. | 336/183 |
| 5,455,563 | 10/1995 | Davies et al. | 340/572 X |
| 5,565,849 | 10/1996 | Ho et al. | 340/572 |
| 5,572,191 | 11/1996 | Lundberg | 340/572 |

FOREIGN PATENT DOCUMENTS

| | | |
|---|---|---|
| 0 459 722 | 12/1991 | European Pat. Off. . |
| 0 295 028 | 4/1993 | European Pat. Off. . |
| 92/07343 | 4/1992 | WIPO . |

*Primary Examiner*—Thomas J. Mullen, Jr.
*Attorney, Agent, or Firm*—Foley & Lardner

[57] ABSTRACT

An antipiliferage tag comprising a soft-magnetic thin film (100) for use as an active element in an electronic article surveillance (E.A.S.) system. The film (100) has an easy axis (102) with a particular direction. The tag has been folded along at least one folding line (104) so that the tag comprises at least two layers which at least partially overlap with each other. The folding line (104) forms an oblique angle different from zero with the direction of the easy axis (102) so that the direction of the easy axis (102) in one layer is different from the direction of the easy axis (106) in another layer. In this way an antipiliferage tag which is insensitive to its orientation in a detection gate of an E.A.S. system is obtained.

9 Claims, 3 Drawing Sheets

MAGNETIC ANTIPILFERAGE TAG

FIELD OF THE INVENTION

The present invention relates to an antipiliferage or anti-theft tag for in an electronic article surveillance system (E.A.S.). Such an antipiliferage tag comprises a soft-magnetic thin film for use as an active element which is insensitive to its orientation in a detection gate of an E.A.S. system. The present invention also relates to a method of making an antipiliferage tag insensitive to its orientation in such a detection gate.

BACKGROUND OF THE INVENTION

Such antipiliferage tags or markers which comprise a soft-magnetic thin film for use as an active element are known in the art.

The term 'thin' herein refers to a film having a thickness which is smaller than 10 micrometers, or smaller than 5 micrometers, e.g., about 1 to 2 micrometers.

The term 'soft-magnetic' stays in contradiction with a magnetically hard or semi-hard material. The term 'soft-magnetic' refers to materials having a rather low coercive force, for example a coercive force lying below 500 A/m, preferably from 3 to 100 A/m.

Such a soft-magnetic thin film can be made of an amorphous metal glass with only a limited amount of crystalline phases. An example of such a material is $Co_kFe_iNi_mMo_n$-$Si_oB_p$ and is disclosed in EP-B1-0 295 028. Such a soft-magnetic thin film can be manufactured by means of physical vapor deposition techniques such as sputtering processes.

The terms 'use as an active element' mean that, if the antipilferage tag is not deactivated at the point of sale, the active element must trigger a particular alarm signal in an alternating magnetic field at a detection gate which may be installed at the exit of a shop.

The antipilferage tag also comprises a deactivating material usually in the form of a magnetically hard or semi-hard material with a high coercive force which ranges, for example, from 4000 to 20,000 A/m. After deactivation of the antipilferage tag, usually at the point and at the moment of sale, the active element, i.e. the soft-magnetic thin film, is kept in saturation and no longer causes a typical response in a detection gate.

The antipilferage tag usually also comprises, next to the soft-magnetic film a thin organic substrate (thickness: e.g., about 23 μm), e.g., of a polyester or of a polyethylene terephtalate, an organic overlayer of e.g., polypropylene and an adhesive to adhere the antipilferage tag to the products to be protected.

One of the problems with soft-magnetic thin films in particular, and with thin films in general, is that they have a so-called 'easy axis', which is a magnetic preferential orientation. This easy axis lies in the plane of the film and is usually perpendicular to the direction of movement of the film during its manufacturing process. The existence of this easy axis causes a dead angle for the label which may amount up to a total angle of 180°, under which the soft-magnetic thin film does not trigger an alarm signal in a detection gate, even if not deactivated.

SUMMARY OF THE INVENTION

The invention aims at avoiding the problems of the prior art. It is an object of the present invention to provide for an antipilferage tag which is highly insensitive to its orientation in a detection gate. It is also an object of the present invention to provide for a simple method of making an antipilferage tag insensitive to its orientation.

According to the invention there is provided for an antipilferage tag which comprises a soft-magnetic thin film for use as an active element. The film has an easy axis with a particular direction. The tag has been folded along at least one folding line so that the tag comprises at least two layers which at least partially overlap with each other. The folding line forms an oblique angle different from zero with the direction of the easy axis so that the direction of the easy axis in one layer is different from the direction of the easy axis in another layer.

The oblique angle preferably ranges from 30° to 60° and is preferably about 45°. The advantage of an oblique angle of 45° is that the direction of the easy axis in one layer becomes perpendicular to the direction of the easy axis in another layer. Such a situation gives the highest degree of insensitivity of the orientation of the tag in a detection gate.

The different layers may be bound to each other by means of an adhesive.

Preferably the overlapping of the layers is 100%. The reason here is again that such a situation gives the highest degree of insensitivity of the orientation of the tag in a detection gate.

The antipilferage tags according to the invention may take a lot of geometrical forms which depend upon the ultimate use of the tag. Rectangular, square, triangular and circular forms are, however, very common forms which may be used in a lot of practical situations of source-labeling of products.

According to the invention, there is also provided for a method of making an antipilferage tag insensitive to its orientation in a detection gate of an antipilferage system. The method comprises a step of folding the tag at least once along a folding line so that the tag comprises at least two layers which at least partially overlap with each other. The folding line forms an oblique angle different from zero with the direction of the easy axis so that the direction of the easy axis in one layer is different from the direction of the easy axis in another layer.

According to a broad and general aspect of the present invention, there is provided for a planar magnetic material having a direction of preferential orientation. The planar magnetic material has been folded along at least one folding line so that the planar magnetic material comprises at least two layers which at least partially overlap with each other. The folding line forms an oblique angle different from zero with the direction of preferential orientation so that the direction of preferential orientation in one layer is different from the direction of preferential orientation in another layer.

BRIEF DESCRIPTION OF THE DRAWINGS

The invention will now be described to more detail with reference to the accompanying drawings wherein.

DESCRIPTION OF THE PREFERRED EMBODIMENTS OF THE INVENTION

First Example

Figure 1:
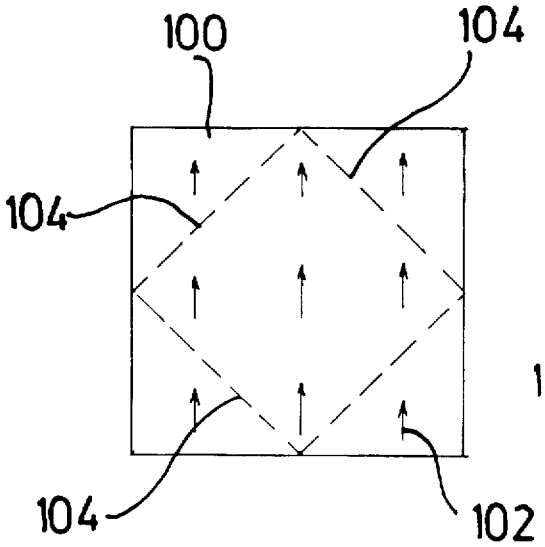
FIGS. 1, 2 and 3 illustrate a first way of how a square antipilferage tag may be folded according to the invention.
Figure 2:
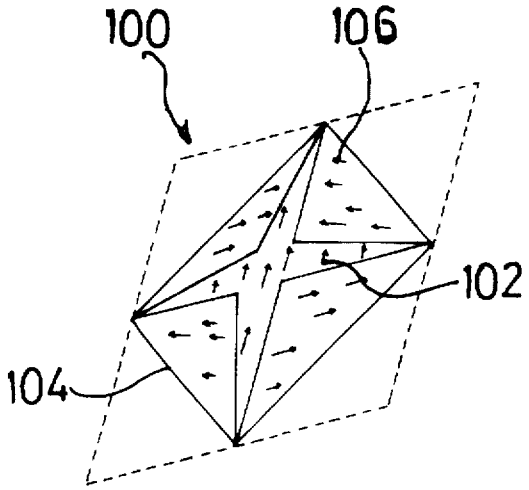
Figure 3:
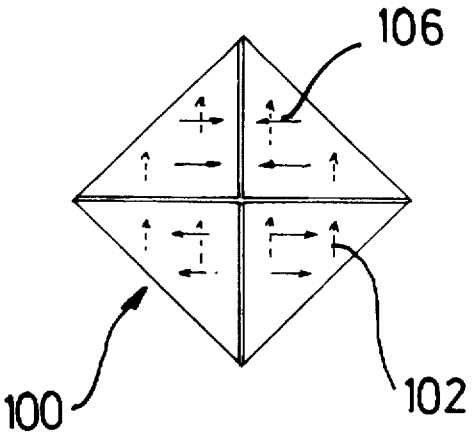

FIGS. 1, 2 and 3 illustrate how an antipilferage tag for use inside capsules of bottles is made.

FIG. 1 shows a square piece of a tag 100 having a soft-magnetic thin film and having a side of 28 mm and having the direction of its easy axis 102 parallel to one pair of sides. Referring to both FIGS. 1 and 2, the square tag 100 will be folded according folding lines 104 (illustrated by means of dash lines) which make an angle $\alpha$ of 45° with the direction of the easy axis 102. The result is shown in FIG. 3 and is a square piece of a tag 100 with a diagonal line of 28 mm and comprising two layers: an under layer with a direction of easy axis 102 and an upper layer with a direction of easy axis 106 perpendicular to easy axis 102. The upper layer may be bound by means of a suitable adhesive to the under layer. Such a folded square tag 100 can be used inside a capsule of a diameter of 30 mm.

Antipilferage tags according to this first example of the invention have been compared with respect to the sensitivity of their orientation in a detection gate to square tags having also a diagonal line of 28 mm and consisting of only one layer. Table 1 hereunder gives average levels of signal response expressed in mV measured in a detection gate.

TABLE 1

| Angle between axis of detection coil and easy axis of only layer or of under layer (degrees) | Single-layer tag according to the prior art | Double-layer tag according to the invention |
|---|---|---|
| 0 | 376 | 358 |
| 10 | 338 | 322 |
| 20 | 284 | 267 |
| 30 | 226 | 216 |
| 45 | 77 | 144 |
| 60 | 0 | 219 |
| 90 | 0 | 307 |

On all tags a surface modulation such as described in WO-A1-92/07343 has been performed.

A single-layer tag according to the prior art does not give a response over at least 30 degrees out of 90 degrees and only gives a weak signal at 45 degrees. In contradistinction herewith, a label according to the invention gives a response of an appropriate level over the complete range of 90 degrees. For reasons of symmetry this means that a tag according to the invention is detectable over 360 degrees.

Obviously the same results as the invention tag can be achieved by cutting two square pieces of soft-magnetic films, turning one piece over 90° and adhering the two pieces to each other. Having regard to the fact that the direction of easy axis is a direction which is not visible, this is an operation which is more difficult to carry out and to automate than a method according to the invention. In a method according to the invention, the only thing that must be carefully watched is that the direction of the easy axis makes an oblique angle different from zero with the folding lines. This is straightforward since the direction of the easy axis is perpendicular to the direction of movement of the film during its production. So if one pair of sides of the square tag is parallel to the direction of movement of the film, the direction of the easy axis will be parallel to one pair of sides of the square and the tag may be folded according to FIGS. 1, 2 and 3.

Second Example

Figure 4:
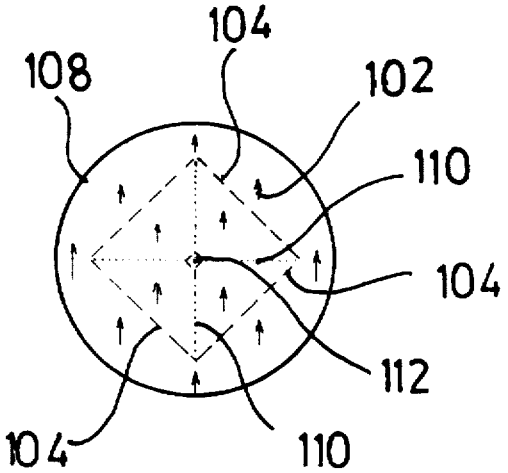
FIGS. 4, 5 and 6 illustrate how an antipilferage tag of an annular form may be formed according to the invention.

A second example of an antipilferage tag according to the invention fits also inside a round geometry and, in addition to the tag of the first example, has also a hole with particular dimensions in its center. Such tags with for example a hole within which round apertures of 15.5 mm diameter fit, can be used for antitheft labeling of compact discs. FIG. 4 illustrates the starting material which is a round tag 108 with a diameter of 29 mm (or 33 mm). Dotted lines 110 form the diagonal lines of a square having as sides the folding lines 104 with a length of 15.5 mm so that a round aperture of 15.5 mm diameter exactly fits therein.

The tag 108 is cut along dotted lines 110 and along dotted lines 112. The reason for cutting along lines 110 is to allow the next folding step illustrated in FIG. 5. The reason for cutting along lines 112 is to prevent the second layer from extending beyond the border of tag 108 after folding see FIG. 6).

Figure 5:
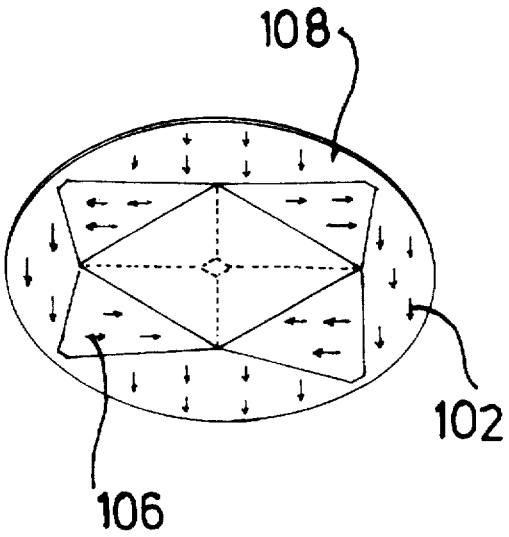
Figure 6:
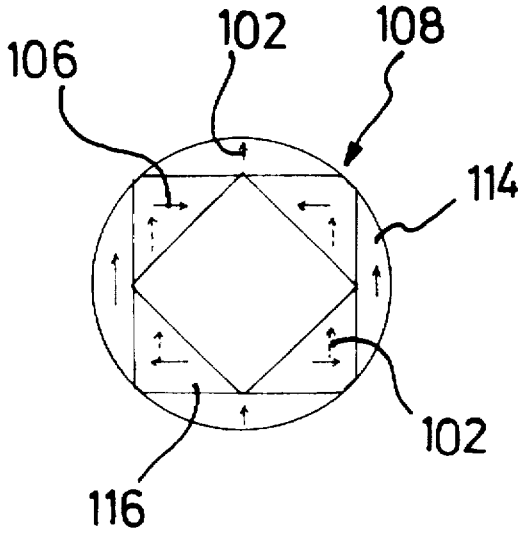

After the cutting operations, parts of the tag 108 are folded along folding lines 104 as illustrated in FIG. 5. The result is a tag as shown in FIG. 6 with a circular form, a part 114 with no overlapping, thus consisting of only one layer with only one direction of easy axis 102 and a part 116 with overlapping and consisting of two layers with two directions 102 and 106 of the easy axis.

A tag according to this second example has been compared with an annular tag having an inner diameter of 15.5 mm and an outer diameter of 29 mm with respect to their levels of responses in a detection gate. The results have been summarized in table 2 hereunder.

TABLE 2

| Angle between axis of detection coil and easy axis of only layer or of under layer (degrees) | Annular tag with single layer according to the prior art | Tag with partially a double layer according to the invention (with surface modulation) | Tag with partially a double layer according to the invention (without surface modulation) |
|---|---|---|---|
| 0 | 345 | 282 | 331 |
| 10 | 323 | 253 | 327 |
| 20 | 264 | 210 | 322 |
| 30 | 195 | 164 | 291 |
| 45 | 75 | 95 | 209 |
| 60 | 4 | 77 | 147 |
| 90 | 0 | 96 | 138 |

It can be derived from table 2 that an antipilferage tag according to the prior art gives almost no signal over at least a range of 30 degrees, whereas the antipilferage tags according to the invention give a response of a proper level over the whole range of 90 degrees.

The antipilferage tag according to the invention without surface modulation gives better results than an antipilferage tag according to the invention with surface modulation, which is an advantage since this makes a supplementary step in the manufacturing process of a antipilferage tag superfluous.

The terms 'surface modulation' are herein used in the same meaning as international application WO-A1-92/07343 and may consist, for example, in removing material from the soft-magnetic thin film in order to increase the level of response of the tag in a detection gate.

Third Example

In a third example another way is disclosed of making square antipilferage tags according to the invention.

Figure 7:
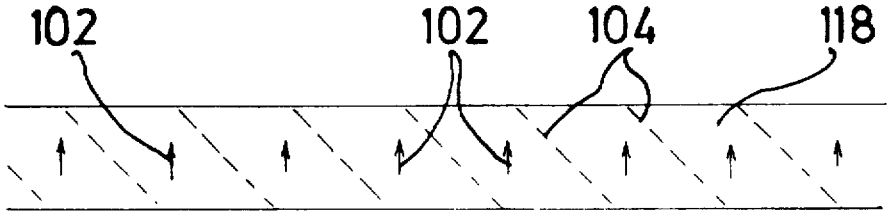
FIGS. 7, 8, 9, 10 and 11 illustrate a second way of how square antipilferage tags according to the invention may be made.
Figure 8:
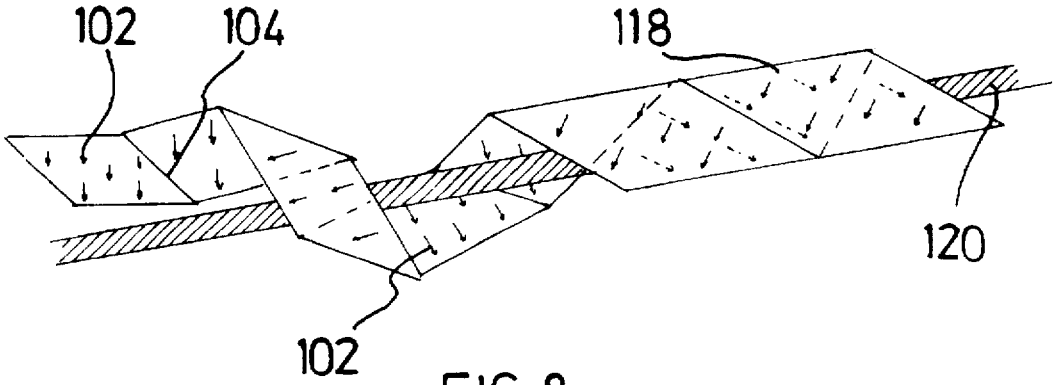
Figure 9:
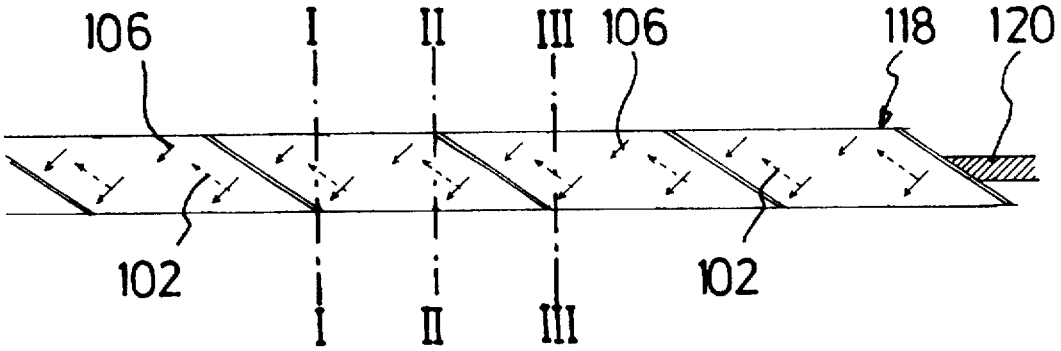
Figure 10:
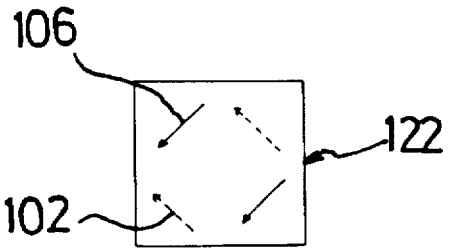
Figure 11:
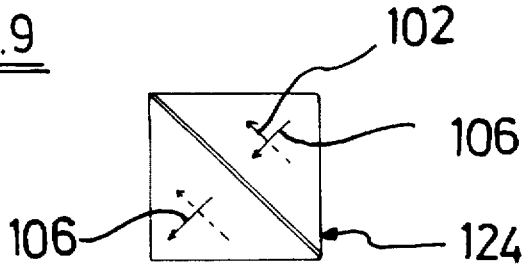

FIG. 7 shows the starting material which is a elongated rectangular strip of a tag 118 that can be made, for example, by cutting the tag along its longitudinal direction. The easy axis 102 is perpendicular to the longitudinal side of strip 118. Folding lines 104 make an angle of 45° with the direction of easy axis 102. These folding lines 104 may be made, for example, by applying a sharpened point to the surface of strip 118. FIGS. 8 illustrates the next manufacturing step where strip 118 is wrapped around a core strip 120 which is adhesive on both surfaces. The strip 118 will fold along folding lines 104 under influence of the wrapping operation and will form a two-layered antipilferage tag, one layer on each side of core strip 120. The intermediate product is shown in FIG. 9. The next step consists in cutting the intermediate product along lines I—I, II—II, III—III in order to obtain square tags 122 and 124 as illustrated respectively in FIG. 10 and in FIG. 11.

Fourth Example

Figure 12:
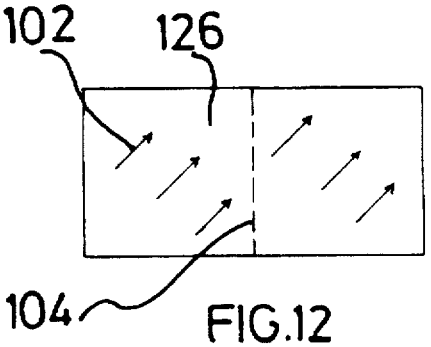
FIGS. 12 and 13 illustrate a third way of how square antipilferage tags according to the invention may be made.
Figure 13:
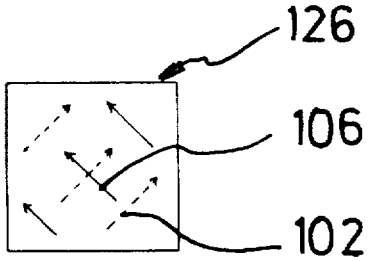

FIGS. 12 and 13 illustrate yet another way of making a square antipilferage tag according to the invention. The start material, shown in FIG. 12, is a rectangular piece of a tag 126, having long sides which are twice as long as the short sides. Both sides make an angle of 45° with the direction of easy axis 102. Folding the rectangular piece of tag 126 along folding line 104 results in the double-layered square tag of FIG. 13.

Fifth Example

Figure 14:
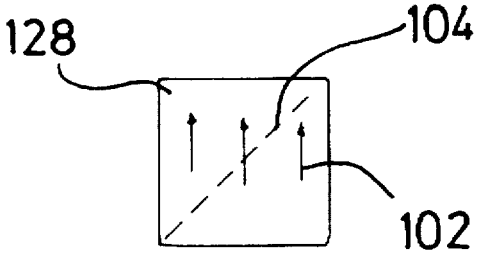
FIGS. 14 and 15 illustrate how a triangular antipilferage tag according to the invention may be made.
Figure 15:
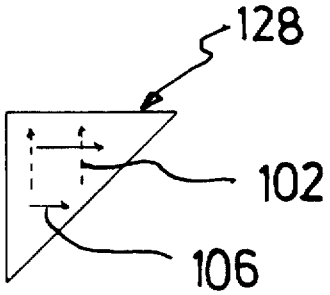

FIGS. 14 and 15 illustrate how a triangular antipilferage tag according to the invention can be made. FIG. 14 shows the start material which is a square piece of tag 128 having one pair of sides parallel to the direction of easy axis 102. Folding the square piece of tag 128 along folding line 104 which is one of the diagonals of the square, results in a triangular two-layered anti-pilferage tag shown in FIG. 15.

We claim:

1. An antipilferage tag comprising a soft-magnetic thin film for use as an active element, said film having an easy axis with a particular direction, said tag being folded along at least one folding line so that said tag comprises at least two layers which at least partially overlap with each other, said at least one folding line forming an oblique angle different from zero with the direction of the easy axis so that the direction of the easy axis in one layer is different from the direction of the easy axis in another layer.

2. An antipilferage tag according to claim 1 wherein said oblique angle ranges from 30° to 60°.

3. An antipilferage tag according to claim 1 wherein said at least two layers are bound to each other by means of an adhesive.

4. An antipilferage tag according to claim 1 wherein there are only two layers.

5. An antipilferage tag according to claim 4 wherein said two layers totally overlap each other.

6. An antipilferage tag according to claim 1 wherein said tag has a square form before folding.

7. An antipilferage tag according to claim 1 wherein said tag has a square form after folding.

8. A method of making an antipilferage tag insensitive to its orientation in a detection gate of an electronic article surveillance system, said antipilferage tag comprising a soft-magnetic thin film as an active element, said film having an easy axis with a particular direction, said method comprising a step of folding said tag at least once along a folding line so that said tag comprises at least two layers which at least partially overlap with each other, said folding line forming an oblique angle different from zero with the direction of the easy axis so that the direction of the easy axis in one layer is different from the direction of the easy axis in another layer.

9. A method according to claim 8 said method further comprising a step of joining said at least two layers to each other by means of an adhesive.

* * * * *